US009236656B2

(12) United States Patent
Kerselaers et al.

(10) Patent No.: US 9,236,656 B2
(45) Date of Patent: Jan. 12, 2016

(54) RADIO FREQUENCY ANTENNA CIRCUIT

(71) Applicants: Anthony Kerselaers, Herselt (BE); Liesbeth Gommé, Anderlecht (BE)

(72) Inventors: Anthony Kerselaers, Herselt (BE); Liesbeth Gommé, Anderlecht (BE)

(73) Assignee: NXP, B.V., Eindhoven (NL)

( * ) Notice: Subject to any disclaimer, the term of this patent is extended or adjusted under 35 U.S.C. 154(b) by 230 days.

(21) Appl. No.: 13/758,257

(22) Filed: Feb. 4, 2013

(65) Prior Publication Data

US 2013/0257676 A1 Oct. 3, 2013

(30) Foreign Application Priority Data

Mar. 30, 2012 (EP) ..... 12162378

(51) Int. Cl.
*H01Q 1/50* (2006.01)
*H01Q 1/27* (2006.01)
*H01Q 9/28* (2006.01)

(52) U.S. Cl.
CPC ..... *H01Q 1/50* (2013.01); *H01Q 1/273* (2013.01); *H01Q 9/285* (2013.01)

(58) Field of Classification Search
CPC ..... H01Q 1/243; H01Q 1/38; H01Q 1/2283; H01Q 9/42; H01Q 23/00
USPC ..... 343/850, 860, 795, 742, 866, 700 MS, 343/793, 893
See application file for complete search history.

(56) References Cited

U.S. PATENT DOCUMENTS

| | | | | |
|---|---|---|---|---|
| 4,918,736 | A | 4/1990 | Bordewijk | |
| 5,111,213 | A | 5/1992 | Jahoda et al. | |
| 5,696,372 | A | 12/1997 | Grober et al. | |
| 5,721,789 | A | 2/1998 | Loffler | |
| 5,973,650 | A * | 10/1999 | Nakanishi | 343/742 |
| 6,680,709 | B2 * | 1/2004 | Kitagawa | 343/742 |
| 6,919,859 | B2 * | 7/2005 | McCarthy et al. | 343/895 |
| 7,616,158 | B2 * | 11/2009 | Mak et al. | 343/700 MS |
| 7,764,236 | B2 * | 7/2010 | Hill et al. | 343/702 |
| 2004/0233111 | A1 * | 11/2004 | Desclos et al. | 343/700 MS |
| 2007/0194993 | A1 * | 8/2007 | Deavours et al. | 343/700 MS |
| 2007/0279287 | A1 * | 12/2007 | Castaneda et al. | 343/700 MS |
| 2010/0309080 | A1 * | 12/2010 | Minemura et al. | 343/788 |

FOREIGN PATENT DOCUMENTS

| | | | |
|---|---|---|---|
| WO | 2005/069438 | A1 | 7/2005 |
| WO | 2011/044333 | A2 | 4/2011 |

OTHER PUBLICATIONS

Extended European Search Report for EP Patent Appln. No. 12162378.9 (Aug. 7, 2012).

* cited by examiner

*Primary Examiner* — Dameon E Levi
*Assistant Examiner* — Hasan Islam

(57) ABSTRACT

Presented is radio frequency antenna circuit for portable and/or compact electronic devices. Embodiments comprise an antenna connected to an unbalanced current feeding arrangement. The unbalanced feeding arrangement may generate common mode currents which increase the overall radiation resistance and efficiency of the antenna circuit.

10 Claims, 7 Drawing Sheets

RADIO FREQUENCY ANTENNA CIRCUIT

CROSS-REFERENCE TO RELATED APPLICATIONS

This application claims the priority under 35 U.S.C. §119 of European patent application no. 12162378.9, filed on Mar. 30, 2012, the contents of which are incorporated by reference herein.

This invention relates to a radio frequency (RF) antenna circuit for use in a portable electronic device such as a hearing aid.

A basic hearing aid typically comprises a microphone, speaker and associated electronics. In such hearing aids, an earpiece microphone converts acoustic waves into electrical signals representing the acoustical waves. The electrical signals are then amplified, processed and converted back into acoustical waves.

It is known to provide a remote control function that controls the amplification and other settings of the earpiece. By way of example, U.S. Pat. No. 5,721,789 describes a hearing aid with a remote control function. It has an antenna that is externally connected to the earpiece of the hearing aid.

More advanced hearing aids use wireless audio communication between two earpieces so that there is only one receiver signal. The method typically used to establish such communication is based on inductive coupling. A relatively large voltage, which can be 12 volts AC, is applied to a coil which generates a magnetic field. Within a short range of this first coil, from a few centimeters to 1 meter, the magnetic field can be induced in a second coil. Using this method, a short range communication link between two earpieces can be established.

Radios communicating in this way use magnetic induction (MI) to establish the wireless link. The MI field is a non-propagating near field that exhibits very high roll-off behaviour as function of distance.

When a communication link has to be established across a larger range, like more than 1 meter, prior art solutions use a radio module that works with electromagnetic (EM) waves. EM waves are able to propagate over large distances and the power rolls off as the inverse of the square of the distance from the source. However, it is difficult to implement a radio module in the earpiece due to size and power-consumption requirements. Known arrangements therefore implement a radio module in the remote control unit. In such an arrangement, a first communication is established between the earpiece and the remote control based on inductive near field coupling, and a second communication is established between the remote control unit and further electronic equipment (like a cellular phone) by means of electromagnetic radiation. Several hearing aid products based on this concept are known and available to purchase, of which some employ the Bluetooth™ standard as the second communication protocol.

The antenna bandwidth represents the frequency range in which the antenna can be used with sufficient efficiency. For example, the bandwidth that is required to operate in the worldwide 2.4 GHz ISM band is 84 MHz. It is well-known that antenna bandwidth is proportional to antenna size.

Another factor associated with the design of integrated antennas is the desired input impedance. It is normally preferred to have a reasonable impedance matching between the antenna and the RF integrated circuit. Without proper matching, available power from the RF integrated circuit is not accepted by the antenna and reflected back to the source. A measure of matching quality can be expressed by the Return Loss over the operating band.

Integrating an antenna that suits electromagnetic radiation in a physically small (i.e. portable) electronic device, such as a hearing aid, therefore presents various problems. Portable electronic devices usually have a dedicated design and/or a small volume. As a result, there may be very little available space for the antenna.

It is well known in the art that the antenna volume defines various antenna parameters. Electrically small antennas are prone to reduced radiation resistance, efficiency and gain. They are difficult to match to the RF integrated Circuit due to a fast changing reactive component of the input impedance.

According to an aspect of the invention there is provided a radio frequency antenna circuit according to the independent claims.

Proposed is an antenna arrangement for portable and/or compact electronic devices, such as a hearing aid, that addresses various problems associated with integrated antennas and offers a sufficient wideband communication channel.

The antenna may be connected to an unbalanced feeding arrangement and a radiating feed line. Such an unbalanced feeding arrangement generates common mode currents in the radiating feed line. In this way, the radiation efficiency may be increased in a small volume.

According to an aspect of the invention there is provided a radio frequency antenna circuit for a portable electronic device comprising: first and second antenna elements; an inductive element connected between the first and second antenna elements; and a feed line comprising first and second electrical conductors connected to the inductive element, wherein the connection arrangement of the first and second electrical conductors to the inductive element is asymmetrical.

Embodiments may be directed to the use of hearing aid systems as wireless communication devices and in particular to high quality audio communication. High quality audio may be understood to be CD-like quality sound having a larger audio bandwidth than voice audio.

Embodiments may operate in the Radio Frequency (RF) bands by means of electromagnetic waves and comprise different components including: an electrically small antenna, an unbalanced feeding structure, a radiating feeding line, and a matching unit close to the receiver and transmitter.

An electrically small RF antenna with unbalanced feeding arrangement is therefore proposed that may be used to generate an electrical field radiation pattern that is perpendicular to the side of a human head.

According to another aspect of the invention there is provided a portable electronic device comprising a RF antenna circuit according to the invention.

Examples of the invention will now be described in detail with reference to the accompanying drawings, in which.

Embodiments relate to an antenna system for small portable electronic products like hearing aids. The antenna system operates in the RF band with electromagnetic radiation and is suitable for integration in physically small electronic devices such as a hearing aid. Further, it is possible that other communication systems simultaneously operate in the device, such as a MI communication system for example.

Typically, the physical volume of a hearing aid is small when compared with the required wavelength of operation. For example, behind the ear (BTE) hearing aids have typical dimensions of 30×12×8 mm (and smaller ones have a size of 20×14×6 mm), whereas the wavelength of the world wide ISM 2.5 GHz band is 12 cm.

The dipole antenna is a popular antenna. Such an antenna requires a total length of a half wavelength, which is therefore 6 cm in the case of an operating frequency of 2.5 GHz.

Another popular antenna is a monopole antenna. Such an antenna consists of a quarter wave radiator 3 cm and a ground plane with a size of at least a half wavelength in one direction 6 cm. Such antennas are therefore difficult to integrate in small portable products (like hearing aids) having physical dimensions smaller than the required antenna size.

An antenna system according to a proposed embodiment comprises the following components: a small antenna; an unbalanced feeding structure; a radiating feeding line; and a matching unit close to the receiver and transmitter.

Figure 1:
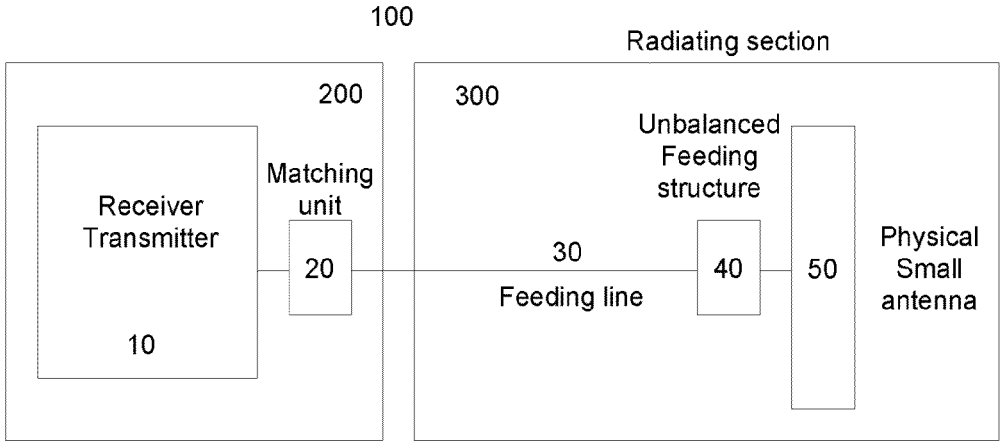
FIG. 1 is a block diagram of a RF antenna system according to an embodiment of the invention.

FIG. 1 is a schematic diagram of such an antenna system 100 having a communications section 200 and a radiation structure 300. The RF port of the receiver or transmitter 10 is connected to a matching unit 20. The distance between both is short. The RF port of the receiver or transmitter 10 can be balanced. The matching unit 20 adapts the input impedance of the radiation structure 300 to the impedance of the RF port of the receiver or transmitter. The matching unit 20 is connected to a radiating feed line 30 which is further coupled to an unbalanced feeding structure 40. The feeding structure 40 is connected to an antenna 50.

Such an antenna system 100 provides an increased efficiency due to providing the ability to generate increased common mode currents in the radiating feed line 30 without requiring an increase of the physical volume of the antenna 50. Further, the radiation pattern can be improved in the sense that more radiation is taking place in different directions when the physically small antenna 50 and the radiating feeding line 30 are positioned in different orientations.

Figure 2A:
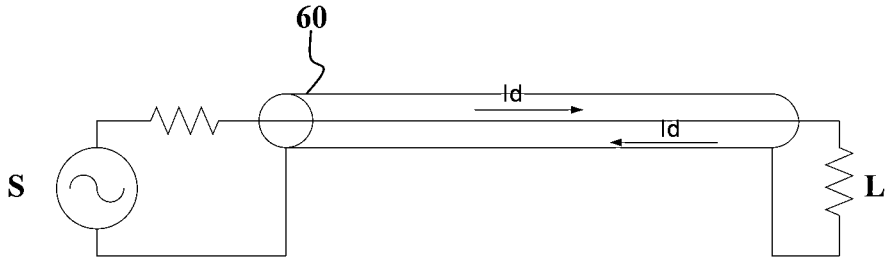
FIGS. 2A and 2B illustrate the generation of a common mode current within a coaxial cable.

In FIG. 2A, the differential mode (Id) current can be seen on a coaxial cable 60. Currents flow at the outer side of conductors for radio frequencies due to the skin effect. For example, at a frequency of 2.5 GHz, the skin depth in a copper conductor is 1.3 μm. This is much less than the thickness of practical conductors. The differential mode current Id flows on the outer side of the inner conductor to the load L and returns at the inner side of the outer conductor to the source S.

Figure 2B:
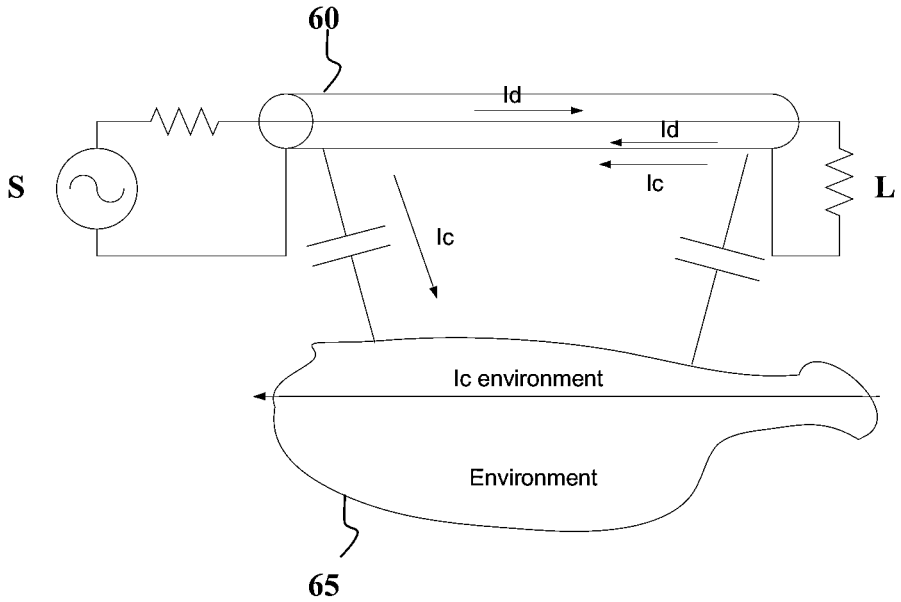

In FIG. 2B, the differential mode currents Id flow like in FIG. 2A. However, due to coupling to a nearby object 65 that radiates electromagnetic energy or carries RF current, a common mode current Ic is generated in the outer side of the outer conductor of the coaxial cable 60.

Similar effects can occur on balanced feeding lines. The common mode current Ic flows in only one direction, which is in contrast with the differential mode currents Id.

The differential mode currents Id generate magnetic fields that have an opposite direction and thus cancel each other and no radiation takes place. However, the common mode current Ic generates a magnetic field that is not cancelled and radiation takes place. There is thus a radiation resistance increase due to common mode currents Ic flowing through the feeding line, wherein radiation resistance equals radiated power divided by current squared.

It will therefore be appreciated that an unbalanced feeding system in combination with an antenna can generate common mode currents Ic on the feeding line.

Figure 3:
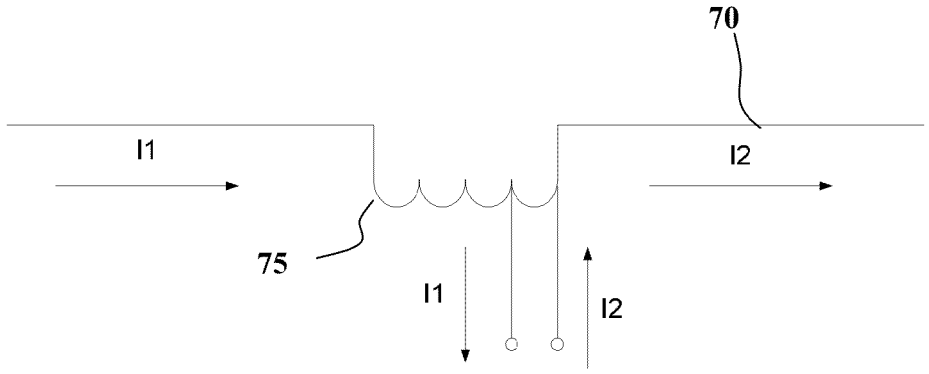
FIG. 3 is a diagram showing an example of an unbalanced feed and balanced antenna according to an embodiment of the invention.

FIG. 3 shows an example of unbalanced feeding configuration connected to a balanced half wave dipole antenna 70. The current I1 is different from current I2 due to the unbalanced feeding arrangement. By applying a voltage source with a frequency tuned to the dipole antenna 70 to the feeding section, a current I1 is generated that is lower than I2 since a coil 75 is in series with the quarter wave antenna element. Part of the current of I2 will be flowing into the feeding line as common mode current.

Figure 4:
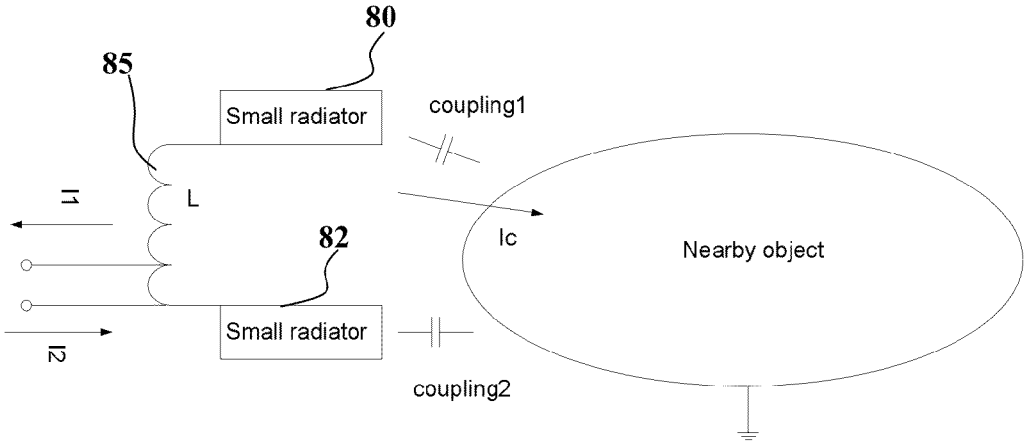
FIG. 4 shows an exemplary embodiment of an electrically small radiating element with an unbalanced feeding arrangement.

It has been found that the combination of a physically small antenna close to a nearby object combined with an unbalanced feeding structure generates even stronger common mode current Ic on the feeding line, as illustrated in FIG. 4. This is because the following two different mechanisms generate common mode current: (i) the unbalanced feeding structure generates different currents on the antenna, and (ii) the unequal amount of coupling of both small antenna elements to the nearby object generates a common mode current.

The coupling to the nearby object can be seen as unbalanced capacitance coupling from which a common mode current component is generated. The common mode current Ic on the feeding line together with its physical size and shape of the antenna increases the overall radiation resistance and efficiency of the antenna system.

FIG. 4 shows a physically small antenna combined with an unbalanced feeding structure. First 80 and second 82 antenna elements are each adapted to resonate at a frequency which is not within the frequency band of interest. They are resonated with the inductive coil element 85 that is connected between the antenna elements 80 and 82. For example, a small antenna element with an input impedance of 5 pF in series with 10 ohms can be resonated with a coil feeding structure of 0.8 nH at a frequency of 2.5 GHz.

To generate larger common mode currents Ic, the feeding is done by means of connecting to the coil 85 in an asymmetric way. In other words, the first and second connections of the feed line are connected to the coil 85 asymmetrically about a central axis of the coil 85. Thus, the first connection of the feed line is connected to the coil at a first point, and the second connection of the feed line is connected to the coil at a second point, wherein the first and second points are not equidistant from a central point of the coil.

At resonance, the voltage at the small antenna element is multiplied with the quality factor of the resonance circuit. This results in an increased common mode current Ic since it can be seen as: antenna voltage/effective coupling impedance.

In a second embodiment, an antenna element and unbalanced feeding structure will be explained by reference to different drawings.

Figure 5:
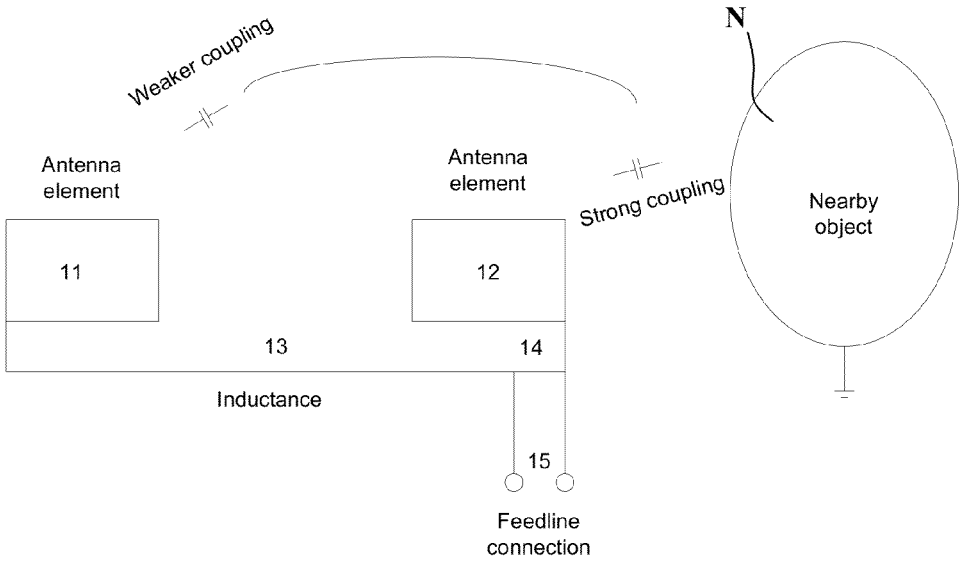
FIG. 5 is a block diagram of a RF antenna circuit according to an embodiment of the invention.

FIG. 5 shows a diagram of an antenna element and unbalanced feeding structure according to an embodiment. First and second antenna elements 11 and 12 are capacitively coupled and do not resonate at the frequency band of interest. The input impedance is capacitive with a series resistance. The resistance is composed of the radiation resistance together with the loss of the antenna elements.

An inductance 13, 14 is connected between the antenna elements 11, 12 and arranged to compensate for the capacitance formed by the two antenna elements 11,12. The feed line connections 15 are unbalanced and connected to the inductance 13,14 so that the structure generates common mode currents. In other words, the two feed line connections 15 are connected to the inductance asymmetrically, such that the inductance is split into first 13 and second 14 inductances of differing size.

The two antenna elements 11, 12 have different coupling impedances to a nearby object due to their differing distance from the nearby object N. This can be other conductors in the hearing aid like the ground reference and the feeding line (not shown on FIG. 5). As has been explained above, the unequal amount of coupling of both small antenna elements to the nearby object generates a common mode current component, thus resulting in amplification of the common mode current Ic on the feed line connection.

Figure 6:
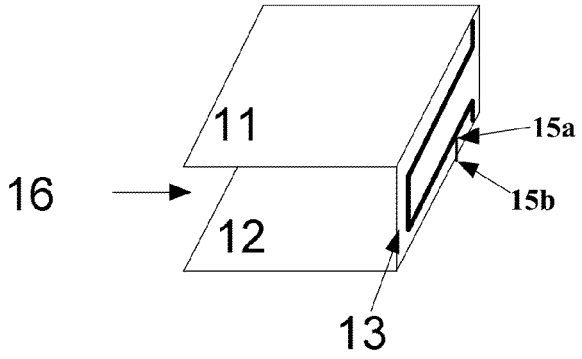
FIG. 6 illustrates a first implementation example of a RF antenna circuit according to an embodiment.

FIG. 6 shows a first implementation example of an antenna and feed arrangement according to an embodiment. First 11 and second 12 antenna elements are formed from a conductive material, for example a thin copper sheet. The antenna elements 11, 12 are separated by means of a dielectric substrate material 16. This can be air or other low loss dielectric material. The two antenna elements together with the dielectric substrate are adapted to not resonant at the required frequency of interest.

On one side of the dielectric substrate material 16, there is a distributed inductance 13 between the first 11 and second 12 antenna elements. The inductance 13 together with the antenna elements 11,12 and the substrate are adapted to resonate at the required frequency of interest.

The first 15*a* and second 15*b* feed line connections are connected to the inductance 13 asymmetrically so that the feeding arrangement is unbalanced and the structure generates common mode currents. In other words, the two feed line connections 15*a* and 15*b* are connected to the inductance 13 at different distances from a central axis of the inductance 13.

The unbalanced connection of the two feed line connections 15*a*,15*b* to the inductance 13 can be seen on the side of the inductance closest to the second antenna element 12.

Exemplary dimensions of such a structure for operation at 2.5 GHz (i.e. where the frequency of interest is 2.5 GHz) may be as follows:

- Antenna elements: 8×12 mm, copper material of 0.1 mm thickness.
- An air substrate with 4 mm separation between the two antenna elements.
- The inductor and unbalanced feed are constructed by means of copper conductors of 35 μmeter thickness on printed circuit board material, for example Rogers 4003.

Figure 7:
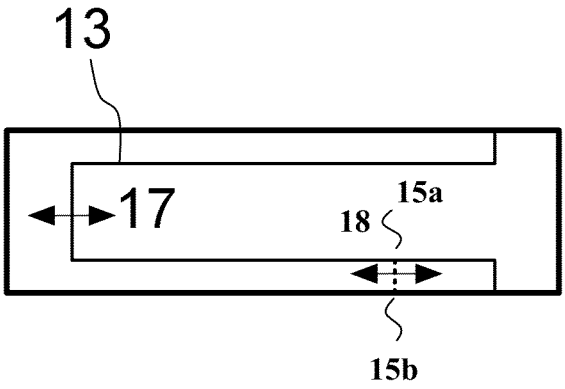
FIG. 7 is a side view of the implementation example of FIG. 6.

FIG. 7 shows the details of the inductance and feeding means of the exemplary embodiment of FIG. 6. The conductive part may be varied (as indicated by the arrow labelled "17") tune the resonant frequency to the required value. It has been found that changing the position of the conductive part 17 does not change the input impedance seen at the unbalanced feeding connections.

Also, the input impedance can be changed by varying the position of the feeding connections 15*a* and 15*b*, as indicated by the arrow labelled "18".

Figure 8:
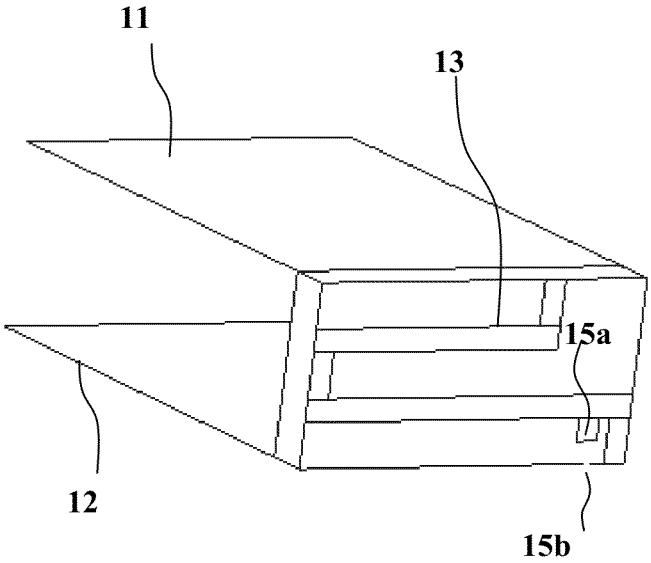
FIG. 8 is an illustration of a simulation model of the exemplary embodiment of FIGS. 6 and 7.

FIG. 8 is an illustration of a simulation model of the exemplary embodiment of FIGS. 6 and 7. More specifically, FIG. 8 shows the 3-dimensional structure that is used for simulation using an industry-leading 3-dimensional electromagnetic simulator (CST Microwave studio) from Computer Simulation technologies.

Figure 9:
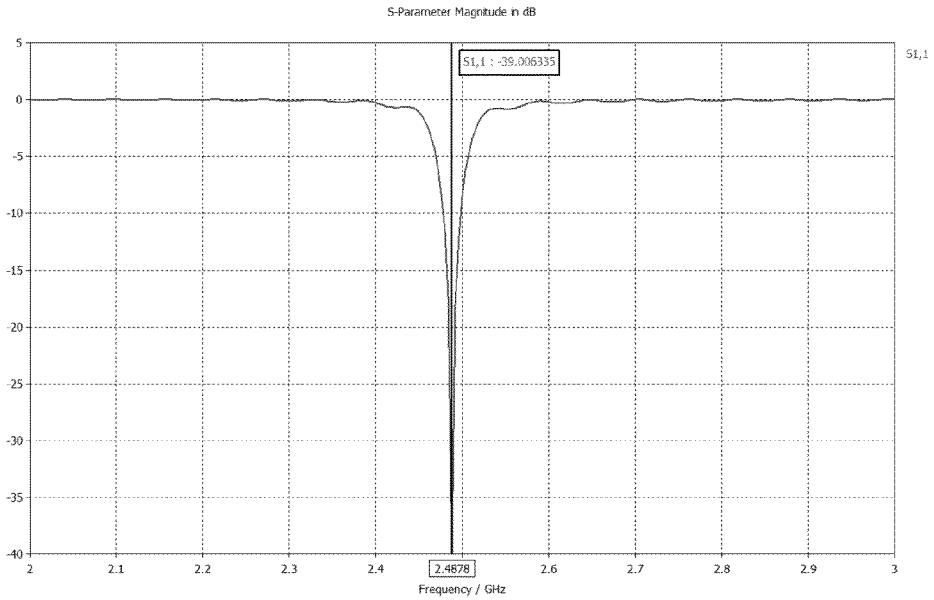
FIG. 9 is a graph showing the simulated return loss at the unbalanced feeding connections of the simulated model of FIG. 8.
Figure 10:
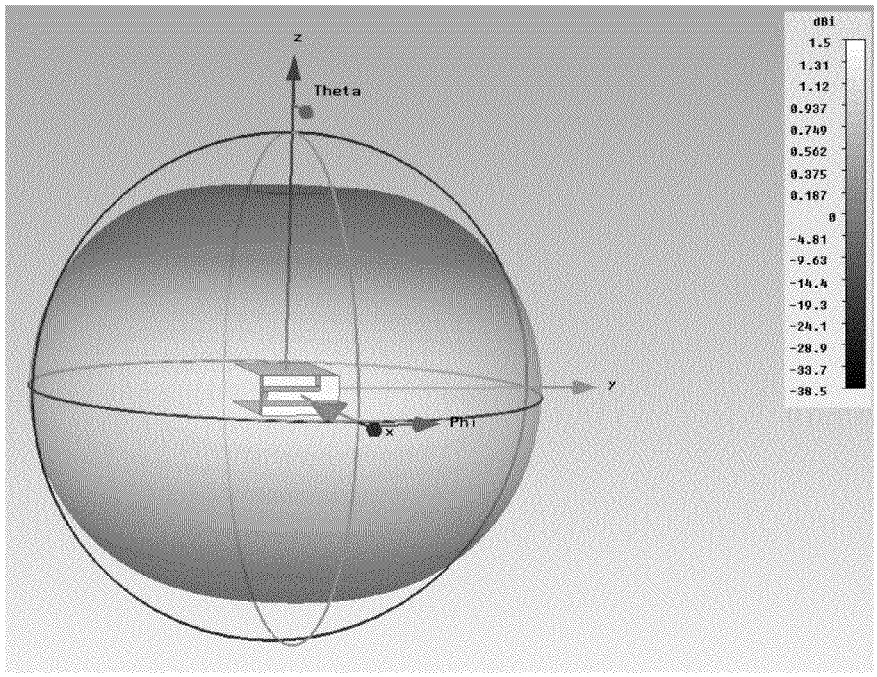
FIG. 10 illustrates the 3-dimensional radiation pattern of simulation model of FIG. 8.

FIG. 9 is a graph showing the simulated return loss at the unbalanced feeding connections of the simulated model of FIG. 8. From this, it can be seen that the combined structure (of the antenna elements, inductance element and feed line connections) resonates at a frequency of 2.48 GHz. FIG. 10 shows the 3-dimensional radiation pattern of this embodiment. It can be noted that if the antenna is placed with the antenna elements parallel to the X-Y plane, an electrical field radiation pattern is generated that is elongated in the in the X-Y plane.

Thus, when an embodiment of the proposed antenna arrangement is placed close to a human head (in a hearing air for example), two different electromagnetic propagation modes can be used (so called, off-body communication mode and on body communication mode).

The off body communication mode may be, for example, wireless communication between the hearing aid and a cellular phone. The on-body communication mode may be, for example, wireless communication between the hearing aid of each ear.

It may be preferable that the off-body communication mode has an electrical field radiation pattern that is mainly parallel with the plane of the substantially vertical side of the user's head, whereas it may be preferable that the on-body communication has an electrical field radiation pattern that is mainly perpendicular to vertical side of the user's head (so that is elongated in the same direction as the separation between the user's ears).

Ear-to-ear communication may be accomplished with a monopole antenna perpendicular to vertical side of the user's head. However, since a typical hearing aid is no larger than 6 mm height this is not feasible.

The proposed antenna arrangement, however, can be of reduced size compared to prior art antenna arrangements whilst providing a similar radiation pattern. Embodiments are therefore advantageous for integration into physically small (i.e. compact) electronic devices such as a hearing aid.

Figure 11:
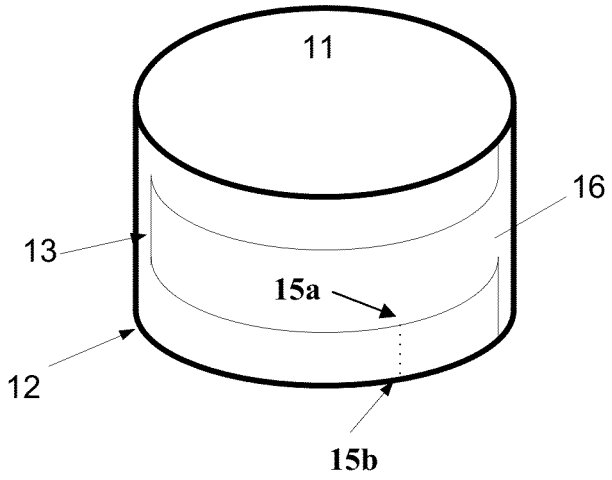
FIG. 11 shows an alternative example of an antenna and feeding structure according to an embodiment.

FIG. 11 shows an alternative embodiment of an antenna and feeding structure. Here, first 11 and 12 second antenna elements are circular electrically conducting planar structures adapted to not resonate in a frequency band of interest.

The first 11 and 12 second antenna elements are arranged parallel to each other and space apart with a dielectric substrate material 16 positioned therebetween.

Connected between the first 11 and 12 second antenna elements is an inductive element 13.

The input impedance is capacitive with a series resistance. The resistance is composed of the radiation resistance together with the loss of the antenna elements. The distributed inductance 13 thus compensates for the capacitance formed by the two antenna elements 11, 12.

The two feed line connections 15*a* and 15*b* are connected to the inductive element 13 in an unbalanced way so that so that the structure generates common mode currents. In other words, the two feed line connections 15*a* and 15*b* are connected towards one end of the inductive element 13 and at different distances from a central point of the inductive element 13. It will be understood that this connection arrangement can be described as asymmetrical since the two feed line connections 15*a* and 15*b* are not connected on opposite sides of a central axis with equal spacing from the central axis (i.e. the two feed line connections 15*a* and 15*b* are not connected in a symmetrical arrangement).

The first 11 and second 12 antenna elements have different coupling impedances to a nearby object, which can be other conductors in the hearing aid like the ground reference and the feeding line (not shown on FIG. 11). This results in amplification of the common mode current on the feeding line and thus increases the radiation efficiency.

Embodiments employ two different concepts for generating common mode current. Firstly, the unbalanced (i.e. asymmetrical) feeding connection of the feed lines to the inductive element generates different currents on the antenna, thus generating a first common mode current component. Secondly, unequal coupling of the first and second antenna elements to a nearby object generates a second common mode current component. The combination of these common mode current components thus provides a stronger common mode current Ic on the feeding line.

Generation of a larger common mode current on the feeding line together with its physical size and shape increases the overall radiation resistance and efficiency of the antenna arrangement.

Various modifications will be apparent to those skilled in the art.

The invention claimed is:

1. A radio frequency antenna circuit for a portable electronic device comprising:

first and second antenna elements;

an inductive element connected between the first and second antenna elements; and a feed line comprising first and second electrical conductors connected to the inductive element, wherein a connection arrangement of the first and second electrical conductors to the inductive element is asymmetrical.

2. The radio frequency antenna circuit of claim 1, wherein the first and second electrical conductors are connected toward one end of the inductive element and at different distances from a central point of the inductive element.

3. The radio frequency antenna circuit of claim 1, wherein the first and second antenna elements are arranged parallel to each other and spaced apart with a dielectric substrate material provided therebetween.

4. The radio frequency antenna circuit of claim 1, wherein the first and second antenna elements are configured to resonate at a first frequency, and wherein the inductive element and the first and second antenna elements have a combined resonant frequency at a second frequency that is different from the first frequency.

5. The radio frequency antenna circuit of claim 4, wherein a maximum dimension of the first and second antenna elements is not more than half of a wavelength of the second frequency.

6. The radio frequency antenna circuit of claim 1, wherein the first and second antenna elements are configured to generate a first common mode current component in the feed line, and the asymmetrical connection of the first and second electrical conductors are configured to generate a second common mode current component in the feed line.

7. The radio frequency antenna circuit of claim 1, further comprising:

a receiver or transmitter unit; and a matching unit connected between the receiver or transmitter unit and the feed line, the matching unit being configured to substantially match an impedance of the radio frequency antenna circuit to an impedance of the receiver or transmitter unit.

8. The radio frequency antenna circuit of claim 4, wherein the first frequency is substantially equal to the second frequency.

9. A portable electronic device comprising the radio frequency antenna circuit according to claim 1.

10. The portable electronic device of claim 9, wherein the portable electronic device is a hearing aid.

* * * * *